US010232973B2

(12) United States Patent
Burke

(10) Patent No.: US 10,232,973 B2
(45) Date of Patent: Mar. 19, 2019

(54) TRAY FOR HOLDING A FOOD PRODUCT

(71) Applicant: Graphic Packaging International, LLC, Atlanta, GA (US)

(72) Inventor: Bradley J. Burke, Wheaton, IL (US)

(73) Assignee: Graphic Packaging International, LLC, Atlanta, GA (US)

( * ) Notice: Subject to any disclaimer, the term of this patent is extended or adjusted under 35 U.S.C. 154(b) by 674 days.

(21) Appl. No.: 14/933,324

(22) Filed: Nov. 5, 2015

(65) Prior Publication Data

US 2016/0130028 A1 May 12, 2016

Related U.S. Application Data

(60) Provisional application No. 62/123,117, filed on Nov. 7, 2014.

(51) Int. Cl.
*B65D 5/24* (2006.01)
*B65D 5/20* (2006.01)

(52) U.S. Cl.
CPC ..... *B65D 5/241* (2013.01); *B65D 5/2047* (2013.01); *B65D 5/244* (2013.01)

(58) Field of Classification Search
CPC ..... B65D 5/241; B65D 5/2047; B65D 5/244; B65D 5/0035
See application file for complete search history.

(56) References Cited

U.S. PATENT DOCUMENTS 622,921 A 4/1899 Fuller
667,634 A 2/1901 Schmidt
1,894,209 A 1/1933 Wikstrom
2,016,754 A 10/1935 Perkit
2,028,276 A 1/1936 Evans
2,037,502 A 4/1936 Cox
2,043,104 A 6/1936 Clancy
2,232,088 A 2/1941 Waters
2,321,848 A 6/1943 O'Reilly
2,740,576 A 4/1956 Franck
2,800,893 A 7/1957 Norman et al.
(Continued)

FOREIGN PATENT DOCUMENTS

EP 0 270 838 6/1988
EP 1 481 922 12/2004
(Continued)

OTHER PUBLICATIONS

International Search Report and Written Opinion for PCT/US2015/059167 dated Feb. 26, 2016.

*Primary Examiner* — Corey N Skurdal
(74) *Attorney, Agent, or Firm* — Womble Bond Dickinson (US) LLP

(57) ABSTRACT

A tray for holding a food product. The tray includes a plurality of panels that extend at least partially around an interior of the tray. The plurality of panels includes a bottom panel, a side panel foldably connected to the bottom panel, and an end panel foldably connected to the bottom panel. The tray includes a rim structure having a rim panel foldably connected to at least one panel of the plurality of panels and a support panel foldably connected to the rim panel. The tray further includes a gusset panel foldably connected to the side panel. The gusset panel and the end panel are at least partially overlapping one another.

41 Claims, 10 Drawing Sheets

(56) References Cited

U.S. PATENT DOCUMENTS 2,836,339 A 5/1958 Pringle
2,858,630 A 11/1958 Gorman
2,944,721 A * 7/1960 Choate ..... B65D 5/2047 220/656
3,276,660 A 10/1966 Vesak
3,300,117 A 1/1967 Kossnar
3,366,306 A 1/1968 Kotowick
3,425,543 A 2/1969 Harvey
3,447,672 A 6/1969 Bailey et al.
3,478,950 A 11/1969 Stevens
3,515,331 A 6/1970 Guthrie, Sr.
3,516,594 A * 6/1970 Stenzel ..... B65D 5/2047 229/114
3,516,595 A 6/1970 Bailey
3,630,430 A 12/1971 Struble
3,637,130 A 1/1972 Farquhar
3,767,108 A 10/1973 Arneson
3,833,113 A 9/1974 Osier
3,845,897 A 11/1974 Buttery et al.
3,876,131 A 4/1975 Tolaas
3,877,632 A 4/1975 Steel
3,912,331 A 10/1975 Turner et al.
3,927,823 A 12/1975 Persson
4,014,496 A * 3/1977 Christensson ..... B65D 5/2019 229/171
4,049,188 A 9/1977 Persson
4,054,241 A 10/1977 Meyers et al.
4,079,853 A 3/1978 Casutt
4,109,848 A 8/1978 Kipp et al.
4,124,160 A 11/1978 Meyers et al.
4,126,265 A 11/1978 Holmes
4,166,567 A 9/1979 Beach, Jr. et al.
4,185,764 A 1/1980 Cote
4,199,097 A * 4/1980 Christensson ..... B65D 5/2019 229/106
4,205,775 A 6/1980 Swan
4,227,640 A 10/1980 Roccaforte
4,244,472 A 1/1981 Brown
4,267,955 A 5/1981 Struble
4,277,506 A 7/1981 Austin
4,283,427 A 8/1981 Winters et al.
4,305,543 A 12/1981 Lai
4,410,129 A 10/1983 Wischusen, III
4,418,861 A 12/1983 McFarland et al.
4,432,489 A 2/1984 Cote
4,502,623 A 3/1985 Moore et al.
4,607,785 A 8/1986 Croley
4,676,429 A 6/1987 Crowe et al.
D290,813 S 7/1987 Forbes, Jr.
4,682,727 A * 7/1987 Stoll ..... B65D 5/0035 206/503
4,765,534 A 8/1988 Zion et al.
4,775,771 A 10/1988 Pawlowski et al.
4,792,084 A 12/1988 Dreeszen
4,801,774 A 1/1989 Hart
4,836,439 A 6/1989 Hart
4,865,921 A 9/1989 Hollenberg et al.
4,871,111 A 10/1989 Mode
4,890,439 A 1/1990 Smart
4,915,235 A 4/1990 Roosa
4,919,267 A * 4/1990 Stoll ..... B65D 5/005 206/507
4,936,935 A 6/1990 Beckett
4,943,456 A 7/1990 Pollart et al.
4,963,424 A 10/1990 Beckett
5,002,826 A 3/1991 Pollart et al.
5,039,364 A 8/1991 Beckett et al.
5,049,710 A 9/1991 Prosise et al.
5,077,455 A 12/1991 Peleg et al.
5,117,078 A 5/1992 Beckett
5,118,747 A 6/1992 Pollart et al.
5,211,330 A 5/1993 Frey
5,213,902 A 5/1993 Beckett
5,221,419 A 6/1993 Beckett
5,232,149 A * 8/1993 Stoll ..... B65D 5/4266 229/105
5,247,149 A 9/1993 Peleg
5,260,537 A 11/1993 Beckett
5,266,386 A 11/1993 Beckett
5,294,765 A 3/1994 Archibald et al.
5,326,021 A 7/1994 Farrell
RE34,683 E 8/1994 Maynard et al.
5,338,921 A 8/1994 Maheux et al.
5,340,436 A 8/1994 Beckett
5,351,879 A 10/1994 Liu et al.
5,354,973 A 10/1994 Beckett
5,410,135 A 4/1995 Pollart et al.
5,412,187 A 5/1995 Walters et al.
5,424,517 A 6/1995 Habeger, Jr. et al.
5,519,195 A 5/1996 Keefer et al.
5,520,322 A 5/1996 Conviser
5,530,231 A 6/1996 Walters et al.
5,535,942 A * 7/1996 Vilona ..... B65D 5/0035 229/122.32
5,628,921 A 5/1997 Beckett
5,672,407 A 9/1997 Beckett
5,718,368 A 2/1998 Rench et al.
5,720,429 A 2/1998 Cordle
5,726,426 A 3/1998 Davis et al.
5,759,422 A 6/1998 Schmelzer et al.
5,762,225 A 6/1998 Byrd
5,800,724 A 9/1998 Habeger et al.
5,816,485 A 10/1998 Bernstein
5,948,308 A 9/1999 Wischusen, III
5,961,035 A 10/1999 Correll
6,019,276 A 2/2000 Auclair
6,050,482 A 4/2000 Cai
6,102,281 A 8/2000 Lafferty et al.
6,114,679 A 9/2000 Lai et al.
6,137,099 A 10/2000 Hamblin
6,150,646 A 11/2000 Lai et al.
6,170,740 B1 1/2001 Clark
D437,557 S 2/2001 Ingelin et al.
6,182,890 B1 2/2001 Sattler et al.
6,204,492 B1 3/2001 Zeng et al.
6,251,451 B1 6/2001 Zeng
6,359,272 B1 3/2002 Sadek et al.
6,371,363 B1 4/2002 Franklin et al.
6,371,364 B1 * 4/2002 Maillot ..... B65D 5/20 206/508
6,414,290 B1 7/2002 Cole et al.
6,433,322 B2 8/2002 Zeng et al.
6,455,827 B2 9/2002 Zeng
6,513,704 B1 2/2003 Perot
6,552,315 B2 4/2003 Zeng et al.
6,561,414 B1 5/2003 Cai
6,588,652 B2 7/2003 Cai
6,677,563 B2 1/2004 Lai
6,717,121 B2 4/2004 Zeng et al.
6,719,190 B2 4/2004 Yocum
6,765,182 B2 7/2004 Cole et al.
6,808,105 B2 10/2004 Lee
7,007,838 B1 3/2006 Bostick, II
7,017,797 B2 3/2006 Goglio
7,019,271 B2 3/2006 Wnek et al.
7,140,532 B2 11/2006 Holt et al.
7,219,828 B2 5/2007 Lombardo
7,232,055 B1 6/2007 Lim
7,273,162 B2 9/2007 Baker
7,323,669 B2 1/2008 Robison et al.
7,328,833 B1 2/2008 Wiley
7,351,942 B2 4/2008 Wnek et al.
7,365,292 B2 4/2008 Cole et al.
7,473,875 B2 1/2009 Fitzwater
7,514,659 B2 4/2009 Lafferty
7,541,562 B2 6/2009 Cole et al.
7,648,031 B2 1/2010 Kari
7,648,059 B2 1/2010 Pavlu, Jr. et al.
7,667,167 B2 2/2010 Fitzwater
7,748,536 B2 7/2010 Cassese et al.
7,762,394 B2 7/2010 Bradford et al.
7,793,821 B2 9/2010 Oliveira
7,798,327 B1 9/2010 Berkani et al.

(56) References Cited

U.S. PATENT DOCUMENTS

| | | | |
|---|---|---|---|
| 7,824,719 | B2 | 11/2010 | Cole et al. |
| 7,893,389 | B2 | 2/2011 | Fitzwater |
| 7,975,871 | B2 | 7/2011 | Wnek et al. |
| 7,982,167 | B2 | 7/2011 | Fitzwater |
| 7,982,349 | B2 | 7/2011 | Popov et al. |
| 8,013,280 | B2 | 9/2011 | Robison et al. |
| 8,063,344 | B2 | 11/2011 | Cole et al. |
| 8,087,570 | B2 | 1/2012 | Ho Fung |
| 8,106,339 | B2 | 1/2012 | Robbins et al. |
| 8,158,914 | B2 | 4/2012 | Wnek et al. |
| 8,183,506 | B2 | 5/2012 | Fitzwater |
| 8,186,570 | B2 | 5/2012 | Learn |
| 8,252,217 | B2 | 8/2012 | Wnek et al. |
| 8,309,896 | B2 | 11/2012 | Fitzwater |
| 8,492,690 | B1 | 7/2013 | Watkins |
| 8,534,536 | B2 | 9/2013 | Mueller et al. |
| 9,078,296 | B2 | 7/2015 | Fitzwater |
| 9,113,648 | B2 | 8/2015 | Burke |
| 9,402,491 | B1 | 8/2016 | Debernardi |
| 2001/0032843 | A1 | 10/2001 | Aronsson et al. |
| 2002/0084319 | A1 | 7/2002 | Yocum |
| 2003/0006273 | A1 | 1/2003 | Tsern et al. |
| 2003/0226881 | A1 | 12/2003 | Liou |
| 2004/0232034 | A1 | 11/2004 | Lebras |
| 2004/0234653 | A1 | 11/2004 | Cogley et al. |
| 2004/0238534 | A1 | 12/2004 | Mast |
| 2005/0082355 | A1 | 4/2005 | Beutler |
| 2005/0184066 | A1 | 8/2005 | Brooks et al. |
| 2005/0194286 | A1 | 9/2005 | Ilyayeva et al. |
| 2005/0205565 | A1 | 9/2005 | Cole et al. |
| 2006/0006215 | A1 | 1/2006 | Chen |
| 2006/0049190 | A1 | 3/2006 | Middleton et al. |
| 2006/0096978 | A1 | 5/2006 | Lafferty et al. |
| 2006/0113300 | A1 | 6/2006 | Wnek et al. |
| 2006/0180644 | A1 | 8/2006 | Baker |
| 2006/0278521 | A1 | 12/2006 | Stowell |
| 2007/0056962 | A1 | 3/2007 | Hopkins, Sr. et al. |
| 2007/0102424 | A1 | 5/2007 | Keefe |
| 2007/0131744 | A1 | 6/2007 | Fitzwater |
| 2007/0131745 | A1 | 6/2007 | Fitzwater |
| 2007/0215611 | A1 | 9/2007 | O'Hagan et al. |
| 2007/0251942 | A1 | 11/2007 | Cole et al. |
| 2007/0251943 | A1 | 11/2007 | Wnek et al. |
| 2007/0262487 | A1 | 11/2007 | O'Hagan et al. |
| 2007/0275130 | A1 | 11/2007 | Cole et al. |
| 2008/0000897 | A1 | 1/2008 | Robbins et al. |
| 2008/0023469 | A1 | 1/2008 | Fitzwater |
| 2008/0035634 | A1 | 2/2008 | Zeng et al. |
| 2008/0047958 | A1 | 2/2008 | Cole et al. |
| 2008/0078759 | A1 | 4/2008 | Wnek et al. |
| 2008/0081095 | A1 | 4/2008 | Cole et al. |
| 2008/0110966 | A1 | 5/2008 | Yocum |
| 2009/0072015 | A1 | 3/2009 | Drew et al. |
| 2009/0090708 | A1 | 4/2009 | Requena et al. |
| 2009/0218338 | A1 | 9/2009 | Futzwater |
| 2010/0025393 | A1 | 2/2010 | Talpaert |
| 2010/0038359 | A1 | 2/2010 | Laubhan et al. |
| 2010/0051675 | A1 | 3/2010 | Sweet |
| 2010/0065556 | A1 | 3/2010 | Cole |
| 2010/0065621 | A1 | 3/2010 | Quaintance |
| 2010/0072197 | A1 | 3/2010 | Neff et al. |
| 2010/0102111 | A1 | 4/2010 | Learn |
| 2010/0122999 | A1 | 5/2010 | Brand |
| 2010/0193509 | A1 | 8/2010 | Fitzwater |
| 2010/0264135 | A1 | 10/2010 | Cole |
| 2011/0024413 | A1 | 2/2011 | Cole |
| 2011/0089227 | A1 | 4/2011 | Kaltman et al. |
| 2011/0114715 | A1 | 5/2011 | House |
| 2011/0132903 | A1 | 6/2011 | Cole |
| 2011/0233266 | A1 | 9/2011 | Pezzoli |
| 2012/0228370 | A1 | 9/2012 | Faulon et al. |
| 2013/0087607 | A1 | 4/2013 | Learn |
| 2013/0299566 | A1 | 11/2013 | Sylvester |
| 2014/0374953 | A1 | 12/2014 | Middleton |
| 2015/0375468 | A1 | 12/2015 | Wnek |

FOREIGN PATENT DOCUMENTS

| | | |
|---|---|---|
| EP | 1 364 558 | 3/2005 |
| EP | 2 240 385 | 6/2008 |
| EP | 2 605 974 | 3/2014 |
| EP | 2 974 973 | 1/2016 |
| FR | 2 867 346 | 9/2005 |
| JP | 4-253670 | 9/1992 |
| JP | 6-293334 | 10/1994 |
| JP | 7-040968 | 2/1995 |
| JP | 2001-247122 | 2/2001 |
| KR | 10-1363935 B1 | 2/2014 |
| WO | WO 94/05563 | 3/1994 |
| WO | WO 02/060223 | 8/2002 |
| WO | WO 03/066435 | 8/2003 |
| WO | WO 2005/077783 | 8/2005 |
| WO | WO 2006/076501 | 7/2006 |
| WO | WO 2007/127235 | 11/2007 |
| WO | WO 2007/127371 | 11/2007 |
| WO | WO 2007/133659 | 11/2007 |
| WO | WO 2007/136839 | 11/2007 |
| WO | WO 2009/006096 | 1/2009 |
| WO | WO 2012/024206 | 2/2012 |

* cited by examiner

TRAY FOR HOLDING A FOOD PRODUCT

CROSS-REFERENCE TO RELATED APPLICATION

This application claims the benefit of U.S. Provisional Patent Application No. 62/123,117, filed Nov. 7, 2014.

INCORPORATION BY REFERENCE

The disclosure of U.S. Provisional Patent Application No. 62/123,117, which was filed on Nov. 7, 2014, is hereby incorporated by reference for all purposes as if presented herein in its entirety.

BACKGROUND OF THE DISCLOSURE

The present disclosure generally relates to packages for holding and displaying food. More specifically, the present disclosure relates to trays having reinforcement features.

SUMMARY OF THE DISCLOSURE

In one aspect, the disclosure is generally directed to a tray for holding a food product. The tray includes a plurality of panels that extend at least partially around an interior of the tray. The plurality of panels comprises a bottom panel, a side panel foldably connected to the bottom panel, and an end panel foldably connected to the bottom panel. The tray includes a rim structure having a rim panel foldably connected to at least one panel of the plurality of panels and a support panel foldably connected to the rim panel. The tray further includes a gusset panel foldably connected to the side panel. The gusset panel and the end panel are at least partially overlapping one another.

In another aspect, the disclosure is generally directed to a blank for forming a tray for holding a food product. The blank includes a plurality of panels comprising a bottom panel, a side panel foldably connected to the bottom panel, and an end panel foldably connected to the bottom panel. The blank includes a gusset panel foldably connected to the side panel and rim features for forming a rim structure when the blank is formed into the tray. The rim features comprise a rim panel foldably connected to at least one panel of the plurality of panels and a support panel foldably connected to the rim panel.

In another aspect, the disclosure is generally directed to a method of forming a tray for holding a food product. The method includes obtaining a blank comprising a plurality of panels comprising a bottom panel, a side panel foldably connected to the bottom panel, and an end panel foldably connected to the bottom panel. A gusset panel is foldably connected to the side panel. The blank further includes rim features comprising a rim panel foldably connected to at least one panel of the plurality of panels and a support panel foldably connected to the rim panel. The method includes forming an interior of the tray at least partially defined by the plurality of panels. The forming of the interior of the tray comprises positioning the gusset panel and the end panel to at least partially overlap one another. The method further includes forming a rim structure by folding the rim panel and the support panel with respect to the side panel.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The package of the present disclosure can be useful in containing a food product such as any suitable type of food product that can be wrapped or sealed and stacked or placed on display. For example, the food product could include vegetables, deli foods, or raw food products. Some suitable food products could comprise sliced meat or cheese, raw meat, or any other suitable food or nonfood product. Further, the package of the present disclosure can be used for color coding, providing brand and product information, and providing value-added features such as recipes and coupons. It is understood that products other than the food products listed herein may be contained in the package. Further, food products contained in this package may be generally triangular, round, square, rectangular, irregular, amorphous, or any other shape. In this specification, the terms "lower," "bottom," "upper," and "top" indicate orientations determined in relation to fully erected and upright packages.

Figure 1:
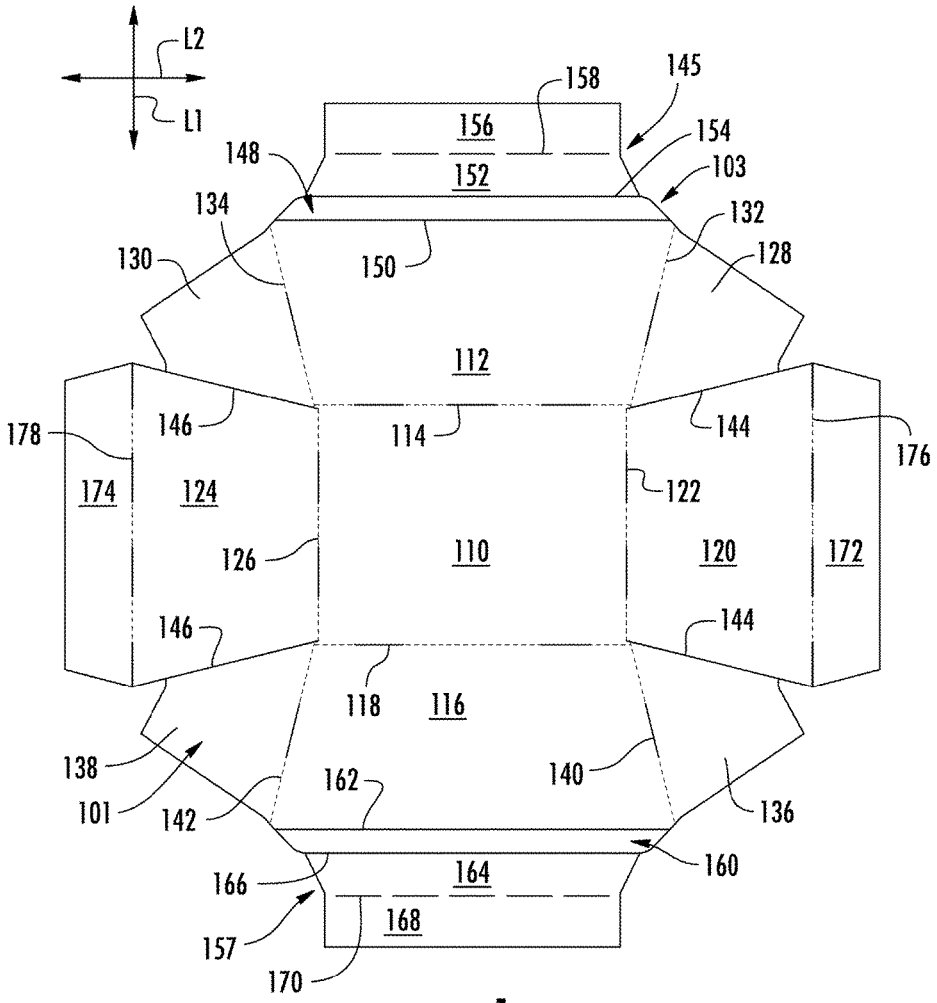
FIG. 1 is an interior plan view of a blank to form a tray in accordance with a first embodiment of the disclosure.

FIG. 1 is a plan view of an interior side 101 of a tray blank, generally indicated at 103, used to form a tray 105 (FIGS. 2-4), with an interior 107, according to a first exemplary embodiment of the disclosure. The tray 105 can be used to hold a food product (not shown). In the illustrated embodiment, the tray 105 is generally rectangular-shaped and can be suitable for holding a food product of any shape (e.g., vegetables, fruit, sliced deli meats or cheeses, ground beef, chicken cutlets, etc.) in a suitable manner for purchase at a grocery store or other retailer, but the package could be otherwise shaped with the same or a different number of side panels to hold correspondingly shaped food products. Further, the tray 105 and blank 103 may be alternatively sized, shaped and/or otherwise arranged to hold any number of food products including a single food product or more than two food products. In one embodiment, the tray 105 is useful for holding the food product during storage in a refrigerator, a freezer, on display on shelves or in a deli case, during heating and/or cooking, and/or during serving or consumption of the food product.

As shown in FIG. 1, the tray blank 103 has a longitudinal axis L1 and a lateral axis L2. In the illustrated embodiment, the tray blank 103 comprises a bottom panel 110 foldably connected to a first side panel 112 at a lateral first fold line 114. A second side panel 116 is foldably connected to the bottom panel 110 at a lateral second fold line 118. A first end panel 120 is foldably connected to the bottom panel 110 at a longitudinal third fold line 122, and a second end panel 124 is foldably connected to the bottom panel 110 at a longitudinal fourth fold line 126. The blank 103 includes gusset panels 128, 130 respectively foldably connected to the first side panel 112 at fold lines 132, 134 located at respective ends of the first side panel. Gusset panels 136, 138 are respectively foldably connected to the second side panel 116 at fold lines 140, 142 located at respective ends of the second side panel. The gusset panels 128, 136 can be separable from respective ends of the first end panel 120 along tear lines or cuts 144, and the gusset panels 130, 138 can be separable from respective ends of the second end panel 124 along tear lines or cuts 146.

Figure 2:
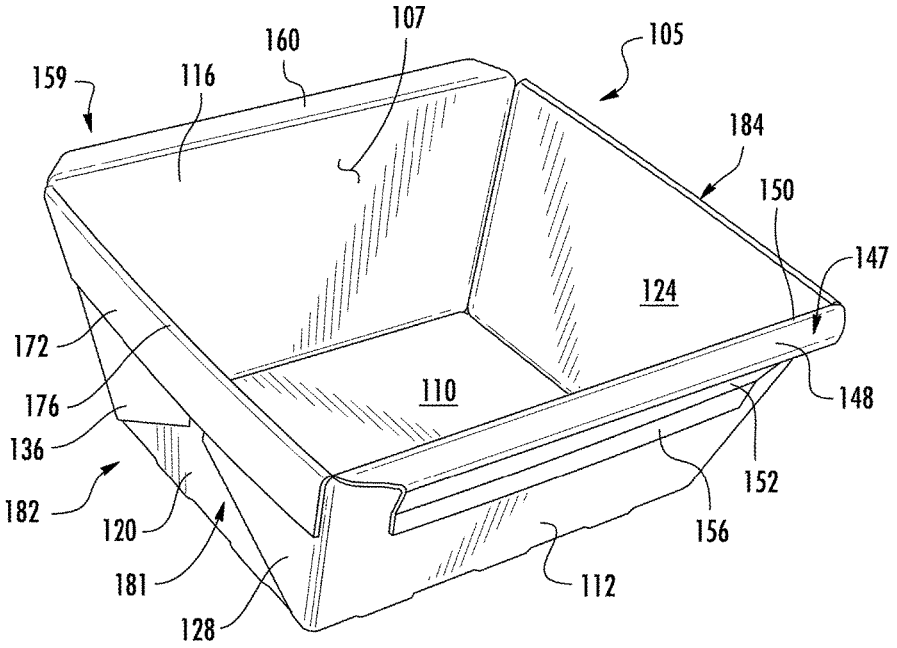
FIGS. 2-4 are perspective views of the tray formed from the blank of FIG. 1 according to the first embodiment of the disclosure.
Figure 3:
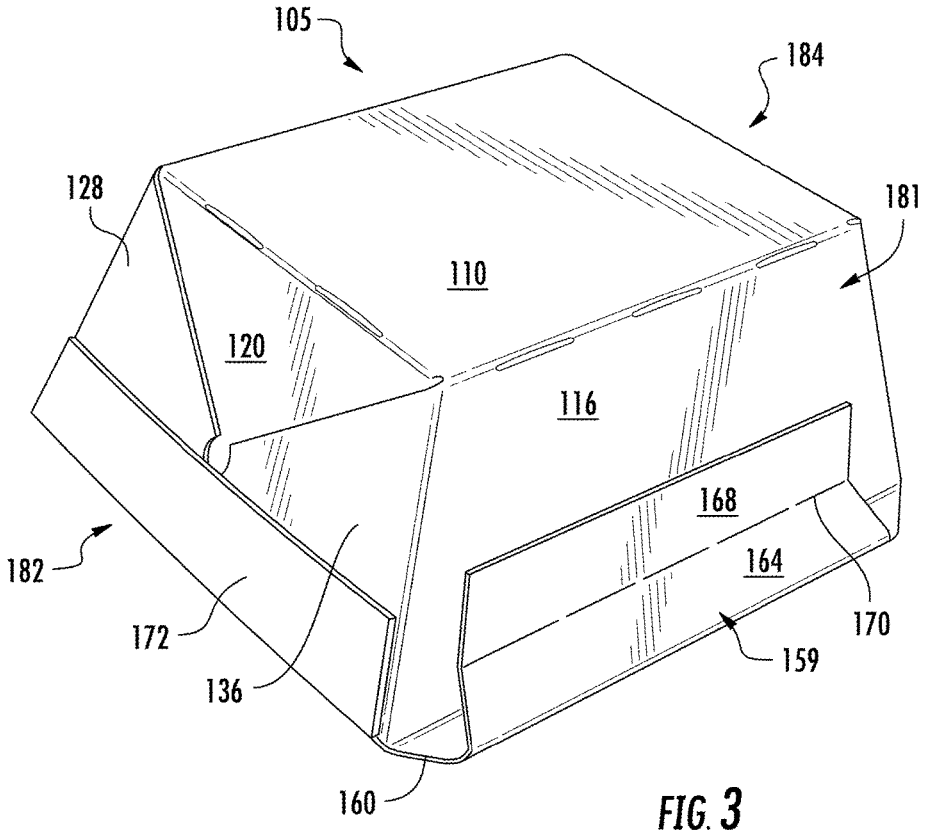
Figure 4:
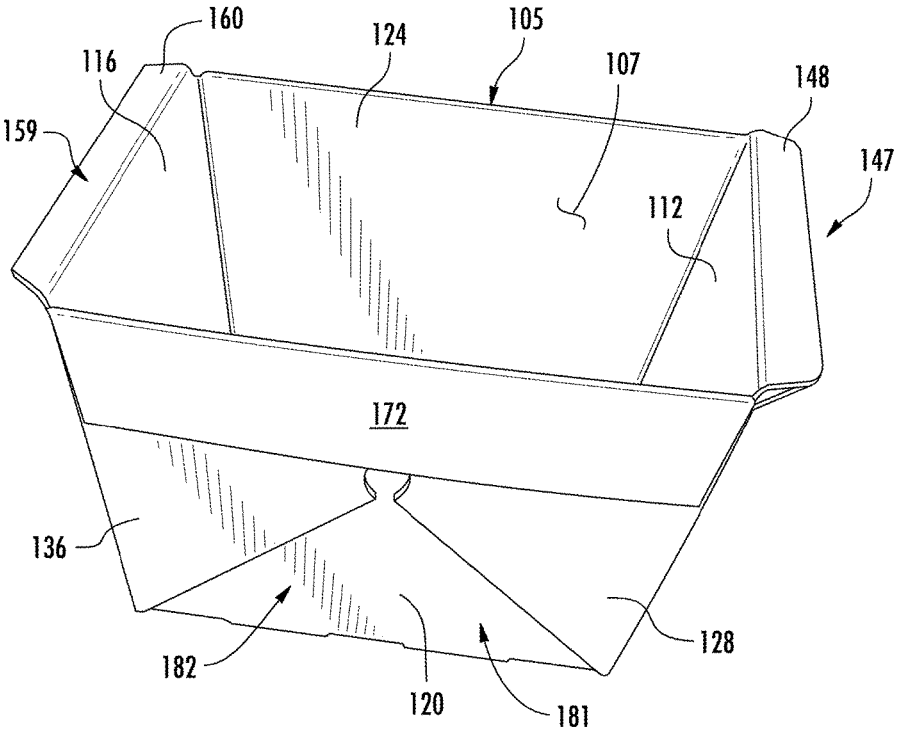

As shown in FIG. 1, the blank 103 includes first rim features 145 for forming a first rim structure 147 in the tray 105 (FIGS. 2-4) and second rim features 157 for forming a second rim structure 159 in the tray 105 (FIGS. 2-4). In the illustrated embodiment, the rim features 145, 157 can be foldably connected to the respective first and second side panels 112, 116. The first rim features 145 can include a first rim panel 148 foldably connected to the first side panel 112 along a lateral fold line 150, a first rim support panel 152 foldably connected to the first rim panel 148 along a lateral fold line 154, and a first attachment flap 156 foldably connected to the first rim support panel 152 along a lateral fold line 158. The second rim features 157 can include a second rim panel 160 foldably connected to the second side panel 116 along a lateral fold line 162, a second rim support panel 164 foldably connected to the second rim panel 160 along a lateral fold line 166, and a second attachment flap 168 foldably connected to the second rim support panel 164 along a lateral fold line 170. In one embodiment, the fold lines 150, 154, 162, 166 are lines of weakening formed by partial cut separated by nicks or portions of material between the cuts that are free from any form of weakening, but it is understood that the fold lines 150, 154, 162, 166 could be other lines of weakening without departing from the disclosure. Further, as shown in FIG. 1, the fold lines 158, 170 are lines of weakening formed by full cuts separated by nicks or portions of material between the cuts that are free from any form of weakening, but it is understood that the fold lines 158, 170 could be other lines of weakening without departing from the disclosure.

In the illustrated embodiment, each of the first and second end panels 120, 124 can include a respective end reinforcement flap 172, 174 (broadly, "reinforcement flap") respectively foldably connected to one of the first and second end panels at a respective longitudinal fold line 176, 178. The blank 103 could be otherwise shaped, arranged, and/or configured without departing from the disclosure. For example, the gusset panels could be foldably connected to the end panels 120, 124 instead of the side panels 112, 116, or the gusset panels could be omitted. Additionally, any of the panels and flaps of the blank 103 can be omitted without departing from the scope of this disclosure.

As shown in FIGS. 2-4, the blank 103 is formed into the tray 105 with an interior 107 by folding the first and second side panels 112, 116 and the first and second end panels 120, 124 relative to the bottom panel 110 along respective fold lines 114, 118, 122, 126. The gusset panels 128, 136 are folded along the respective fold lines 132, 140 and adhered in face-to-face contact with an exterior surface of the first end panel 120 so that the gusset panels are attached to the end panel at the exterior surface 181 of the tray 105. The gusset panels 130, 138 are folded along the respective fold lines 134, 142 and adhered in face-to-face contact with an exterior surface of the second end panel 124 so that the gusset panels are attached to the end panel at the exterior surface 181 of the tray 105. Accordingly, the erected gusset panels 128, 136, 130, 138 in face-to-face contact with the respective end panels 120, 124 form reinforced ends 182, 184 of the tray 105. The ends 182, 184 of the tray 105 can be alternatively, shaped, arranged, and/or configured without departing from the disclosure. For example, the gusset panels 128, 136, 130, 138 could be in face-to-face contact with the interior surfaces of the respective end panels 120, 124.

As shown in FIGS. 2-4, the first rim features 145 can be formed into the first rim structure 147 of the tray 105 by folding the first rim features 145 along the fold lines 150, 154, 158. For example, the first rim panel 148 can be folded along the fold line 150 so that the first rim panel is generally parallel to the bottom panel 110. Additionally, the first rim support panel 152 and the first attachment flap 156 can be folded along the respective fold lines 154, 158 so that the first attachment flap 156 is adhered in face-to-face contact with an exterior surface of the first side panel 112 corresponding to the exterior surface 181 of the tray, and so that the first rim support panel 152 extends obliquely from the first attachment flap 156 to the first rim panel 148. The second rim features 157 can be formed into the second rim structure 159 by folding the second rim features 157 along the fold lines 162, 166, 170. For example, the second rim panel 160 can be folded along the fold line 162 so that the second rim panel is generally parallel to the bottom panel 110. Additionally, the second rim support panel 164 and the second attachment flap 168 can be folded along the respective fold lines 166, 170 so that the second attachment flap 168 is adhered in face-to-face contact with an exterior surface of the second side panel 116 corresponding to the exterior surface 181 of the tray, and so that the second rim support panel 164 extends obliquely from the second attachment flap 168 to the second rim panel 160. The rim structures 147, 159 can be alternatively configured or formed without departing from the scope of this disclosure. For example, the rim features 145, 157 could be folded inwardly to form the respective rim structures 147, 159 and the respective attachment flaps 156 and 168 could be adhered in face-to-face contact with the interior surface of the respective side panels 112, 116.

As shown in FIGS. 2-4, the end reinforcement flaps 172, 174 can be downwardly folded along the respective fold lines 176, 178 over the respective ends 182, 184 of the tray 105. In one embodiment, the end reinforcement flap 172 can be adhered in face-to-face contact with the gusset panels 128, 136 that are in face-to-face contact with the end panel 120. Accordingly, the end reinforcement flap 172 can be downwardly folded to overlap the end panel 120 and the gusset panels 128, 136. Similarly, the end reinforcement flap 174 can be adhered in face-to-face contact with the gusset panels 130, 138 that are in face-to-face contact with the end panel 124. Accordingly, the end reinforcement flap 174 can be downwardly folded to overlap the end panel 124 and the gusset panels 130, 138. As such, the reinforced ends 182, 184 of the tray 104 comprise a respective end panel 120, 124, a respective pair of gusset panels 128, 136 and 130, 138 that are folded in face-to-face contact with the respective end panels 120, 124, and the respective reinforcement flaps 172, 174 that are downwardly folded to overlap the respective pair of the gusset panels 128, 136 and 130, 138 to reinforce the respective end panels 120, 124 and further secure the gusset panels 128, 136, 130, 138. The tray 105 can be formed by other flap or panel positioning steps, and the tray 105 could be otherwise shaped, arranged, and/or configured without departing from the disclosure. For example, the end reinforcement flaps 172, 174 could be folded inwardly in face-to-face contact with the interior surface of the respective end panels 120, 124.

In the illustrated embodiment, the side panels 112, 116 and the end panels 120, 124 of the assembled tray 105 are sloped so that multiple trays 105 can be stacked with one or more trays each nested in the tray below. The rim support panels 152, 164 of an upper tray can engage and rest upon the respective fold lines 150, 162 forming edges of the respective rim panels 148, 160 of a respective lower tray in a nested tray arrangement. In one embodiment, the first rim structure 147 comprises a triangular cross-section formed by the generally horizontal rim panel 148, the oblique rim support panel 152, and the sloped side panel 112. Additionally, the second rim structure 159 can have a similarly formed triangular cross-section. The triangular cross-section can strengthen the rim structures to help resist torsion and folding or buckling of the rims. For example, in one embodiment, the rim structures 147, 159 can provide lateral side panel reinforcement to help inhibit bowing and subsequent damage to products held in the tray 105. In one example, the rim structures 147, 159 can help resist inward pressure on the side panels 112, 116 by a shrink film overwrap that could otherwise cause bowing of the side panels 112, 116.

One or more products, such as raw or prepared food products (not shown), can be inserted into the interior 107 of the tray 105. In one exemplary embodiment, the tray and product(s) can be wrapped in plastic or other material, sealing the product(s) in the tray to keep the product(s) fresh, to prevent contamination of the product(s), and/or to help prevent leaking of fluids. Additionally, an insert, a coating, an absorption pad, or other features can be applied to the tray to help control fluids and/or retain the product(s) in the tray.

Logos, brand information, product information, other printed material, or combinations thereof can be printed on any surface of the tray 105. In one embodiment, the coated exterior surface 101 of the blank 103 provides ideal surfaces of the tray for printing graphics or other indicia. In the illustrated embodiment, the tray 105 can include tear-away panels (not shown) or other features for including coupons, recipes, or other value-added features. In one exemplary embodiment, the tray 105 comprises paperboard and provides a collapsible, crushable, and degradable tray for helping to reduce the volume and duration of waste. Additionally, the paperboard can be recyclable.

In one embodiment, the tray 105 can be formed with either the coated (exterior) surface 101 of the blank 103 forming the interior surface 107 of the tray, or the uncoated (interior) surface of the blank forming the interior surface 108 of the tray. When the exterior, coated surface of the blank is used to form the interior surface 107 of the tray, the interior surface of the side panels 112, 116 and end panels 120, 124 are coated and the exterior surface of the side panels 112, 116 and end panels 120, 124 is uncoated. When the interior, uncoated surface of the blank is used to form the interior surface 107 of the tray, the interior surface of the side panels 112, 116 and end panels 120, 124 are uncoated and the exterior surface of the side panels 112, 116 and end panels 120, 124 is coated. The tray 105 could be formed by other forming steps or processes without departing from the disclosure.

Figure 5:
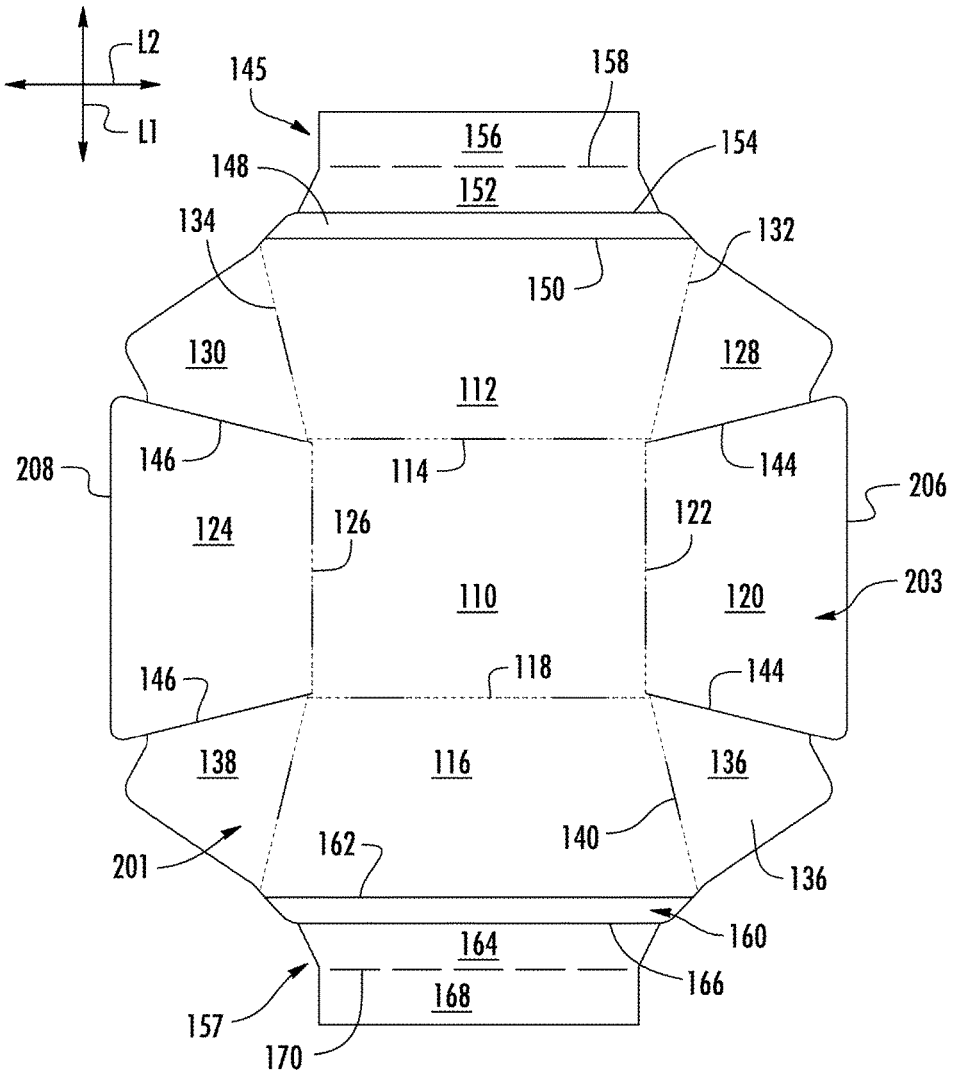
FIG. 5 is an interior plan view of the blank used to for a tray in accordance with a second embodiment of the disclosure.
Figure 6:
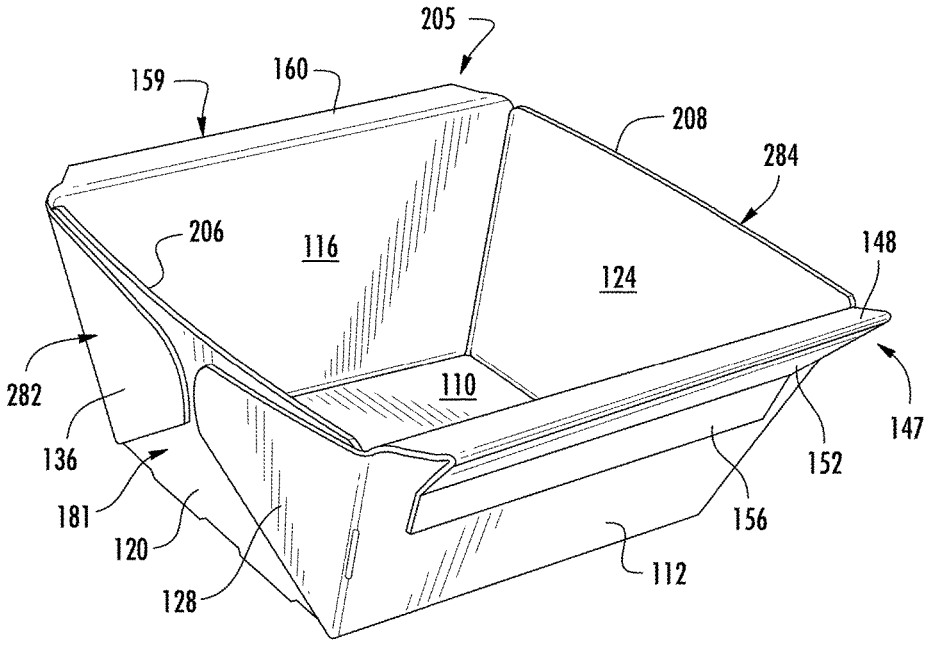
FIGS. 6-8 are perspective views of the tray formed from the blank of FIG. 5 according to the second embodiment of the disclosure.
Figure 7:
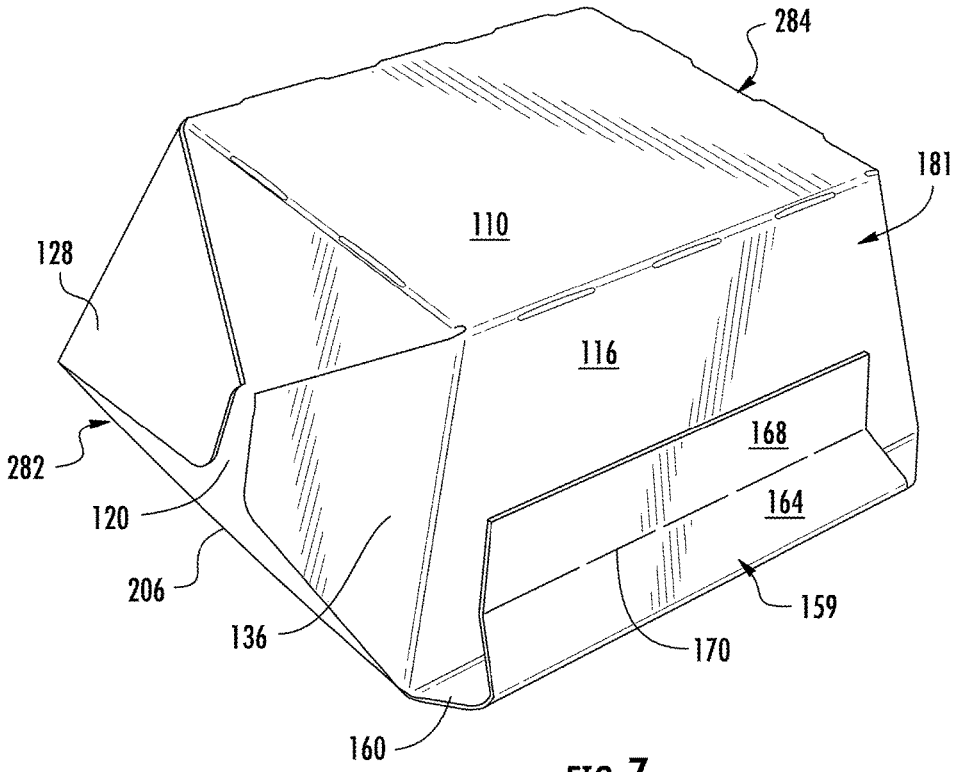
Figure 8:
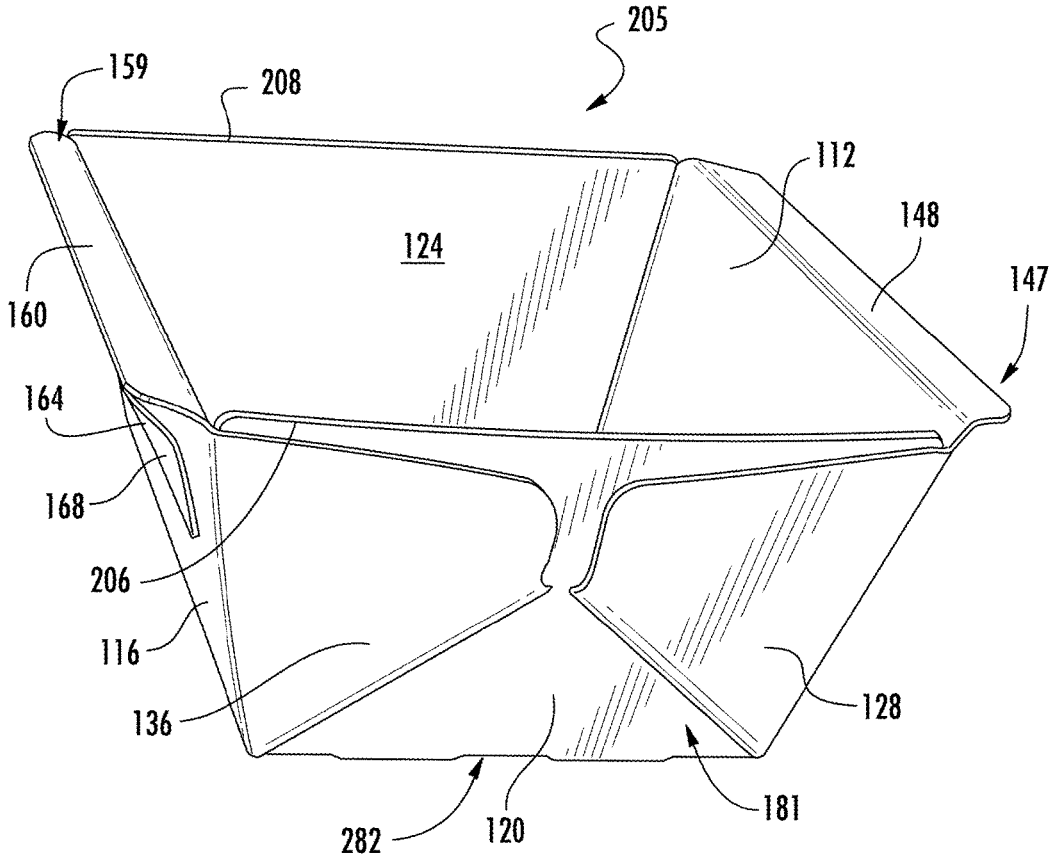

FIG. 5 illustrates an interior side 201 of a blank 203 for forming a tray 205 (FIGS. 6-8) according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 5, the blank 203 includes end panels 120, 124 that have a longitudinal edge 206, 208 instead of the reinforcement flaps 172, 174 of the first embodiment. Accordingly, as shown in FIGS. 6-7, the reinforced end 282 includes the first end panel 120 overlapped by the gussets 128, 136, and the reinforced end 284 includes the second end panel 124 overlapped by the gussets 130, 138. Also in the second embodiment, the lateral fold lines 150, 154, 162, 166 are in the form of cut/crease lines which include 100% cuts and adjacent creases. The fold lines 150, 154, 162, 166 could be other lines of weakening without departing from the disclosure. The blank 203 and/or tray 205 could have other features without departing from the disclosure.

Figure 9:
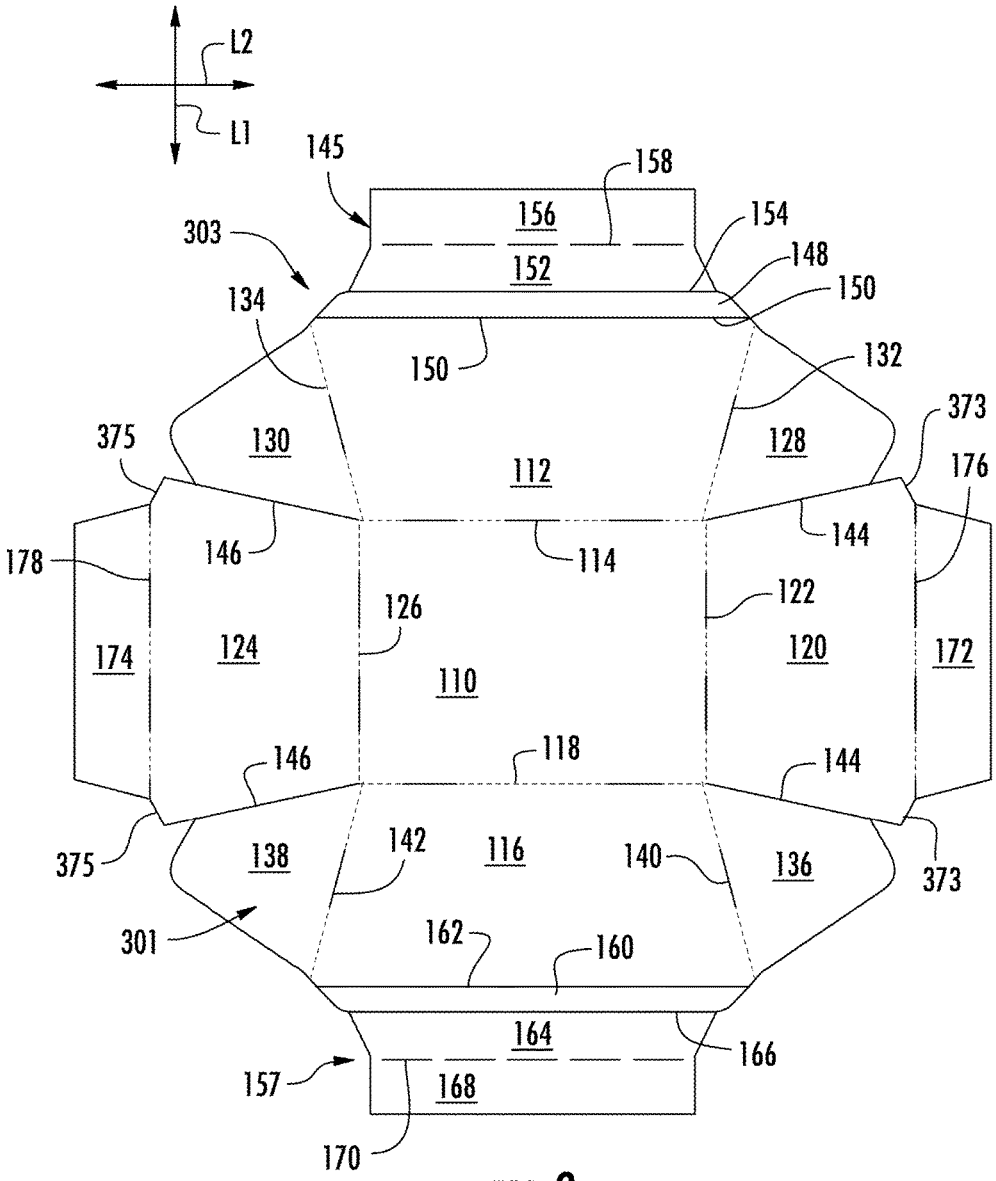
FIG. 9 is an interior plan view of the blank used to for a tray in accordance with a third embodiment of the disclosure.
Figure 10:
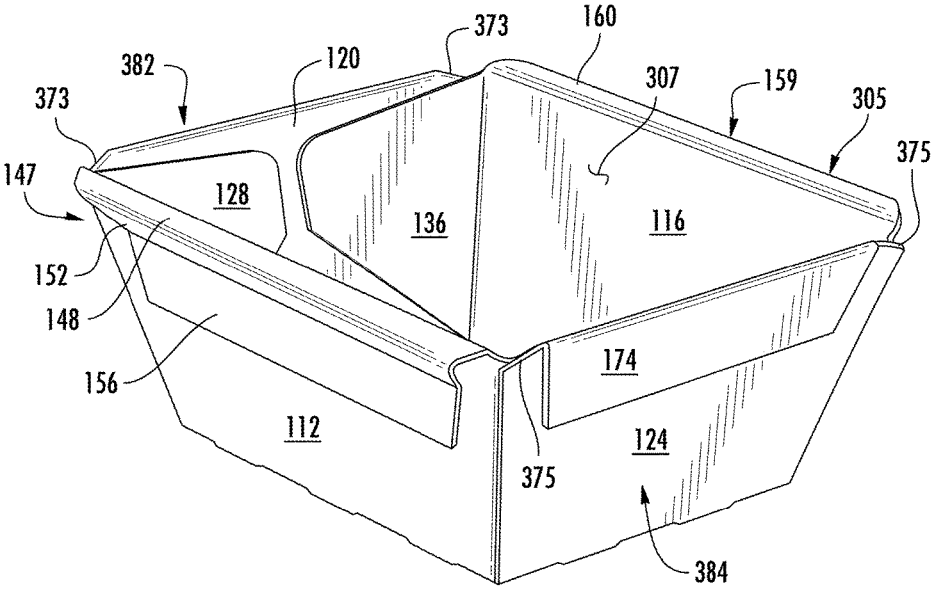
FIG. 10 is a perspective view of the tray formed from the blank of FIG. 9 according to the third embodiment of the disclosure.

FIG. 9 illustrates an interior side 301 of a blank 303 for forming a tray 305 (FIG. 10) according to a third embodiment of the disclosure. The third embodiment is generally similar to the first embodiment, except for variations noted and variations that will be apparent to one of ordinary skill in the art. Accordingly, similar or identical features of the embodiments have been given like or similar reference numbers. As shown in FIG. 9, the first and second end panels 120, 124 can include a lip, shoulder, or edge 373, 375 on either or both sides of the of the end panels adjacent the respective end reinforcement flaps 172, 174. In one embodiment, the edges 373, 375 extend obliquely from the respective fold line 176, 178. As illustrated in FIG. 10, the gusset panels 128, 136, 130, 138 can be inwardly folded to be in face-to-face contact with the interior surfaces of the respective end panels 120, 124. Accordingly, the erected gusset panels 128, 136 and 130, 138 and the respective end panels 120, 124 form the respective reinforced ends 382, 384 of the tray 305 with the gusset panels being in the interior 307 of the tray. The blank 303 and/or tray 305 could have other features without departing from the disclosure.

Any of the various embodiments of the present disclosure generally could include at least one microwave energy interactive element that may comprise a susceptor for becoming hot when exposed to microwave energy, although other types and various combinations of microwave energy interactive elements are also within the scope of the present disclosure. Also, the various embodiments of the present disclosure could be free of a microwave energy interactive element without departing from the disclosure.

A blank according to the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the package to function at least generally as described herein. The blank can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines may include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the package embodiments. The term "glue" is intended to encompass all manner of adhesives commonly used to secure package panels in place.

The foregoing description illustrates and describes various embodiments of the present disclosure. As various changes could be made in the above construction, it is intended that all matter contained in the above description or shown in the accompanying drawings shall be interpreted as illustrative and not in a limiting sense. Furthermore, the present disclosure covers various modifications, combinations, and alterations, etc., of the above-described embodiments that are within the scope of the claims. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A tray for holding a food product, the tray comprising:

a plurality of panels that extend at least partially around an interior of the tray, the plurality of panels comprises a bottom panel, a side panel foldably connected to the bottom panel, and an end panel foldably connected to the bottom panel;

a rim structure comprising a rim panel foldably connected to at least one panel of the plurality of panels at a first lateral fold line, a support panel foldably connected to the rim panel at a second lateral fold line, and an attachment flap foldably connected to the support panel at a third lateral fold line and having a free edge, a first longitudinal distance is defined from the second lateral fold line to the third lateral fold line, and a second longitudinal distance is defined from the third lateral fold line to the free edge of the attachment flap, the first longitudinal distance is approximately equal to the second longitudinal distance; and a gusset panel foldably connected to the side panel, the gusset panel and the end panel at least partially overlapping one another.

2. The tray of claim 1, wherein the rim panel extends generally parallel to the bottom panel, and the support panel extends obliquely with respect to the rim panel and the side panel.

3. The tray of claim 1, wherein the attachment flap at least partially overlaps the side panel.

4. The tray of claim 3, wherein the rim panel extends generally parallel to the bottom panel, and the support panel extends obliquely from the attachment flap to the rim panel.

5. The tray of claim 1, wherein the side panel is a first side panel, the rim structure is a first rim structure and is foldably connected to the first side panel, and the tray further comprises a second side panel foldably connected to the bottom panel and a second rim structure foldably connected to the second side panel.

6. The tray of claim 5, wherein the rim panel, the support panel, and the attachment flap of the first rim structure are a first rim panel, a second rim panel, and a first attachment flap, respectively, and the second rim structure comprises a second rim panel foldably connected to the second side panel, a second support panel foldably connected to the second rim panel, and a second attachment flap foldably connected to the second support panel.

7. The tray of claim 6, wherein the first rim panel and the second rim panel extend generally parallel to the bottom panel, and the first support panel and the second support panel extend obliquely from the respective first rim panel and second rim panel toward the respective first side panel and second side panel.

8. The tray of claim 6, wherein the first attachment flap is at least partially in face-to-face contact with the first side panel, and the second attachment flap is at least partially in face-to-face contact with the second side panel.

9. The tray of claim 6, wherein the end panel comprises a first end panel, the plurality of panels further comprises a second end panel foldably connected to the bottom panel, and the tray further comprises:

a first reinforcement flap foldably connected to the first end panel and at least partially overlapping the first end panel; and a second reinforcement flap foldably connected to the second end panel and at least partially overlapping the second end panel.

10. The tray of claim 9, wherein the first side panel, the second side panel, the first end panel and the second end panel are sloped so that one or more trays may be stacked together in an at least partially nested relationship.

11. The tray of claim 1, further comprising a reinforcement flap foldably connected to the end panel, the reinforcement flap at least partially overlapping the end panel.

12. The tray of claim 11, wherein the reinforcement flap is at least partially in face-to-face contact with an exterior surface of the end panel.

13. The tray of claim 11, wherein the side panel is a first side panel, the gusset panel is a first gusset panel, the plurality of panels further comprises a second side panel foldably connected to the bottom panel, the tray further comprises a second gusset panel foldably connected to the second side panel, the first gusset panel and the second gusset panel are at least partially in face-to-face contact with the end panel, and the reinforcement flap is at least partially in face-to-face contact with the first gusset panel and the second gusset panel.

14. The tray of claim 11, wherein the reinforcement flap is foldably connected to the end panel along a longitudinal fold line, and the end panel comprises an edge extending from an end of the longitudinal fold line toward the bottom panel.

15. The tray of claim 14, wherein the edge of the end panel is oblique with respect to the longitudinal fold line.

16. The tray of claim 14, wherein the edge of the end panel is a first edge, the end panel comprises a second edge extending from the first edge to the bottom panel.

17. The tray of claim 1, wherein the rim panel extends obliquely upwardly from the first lateral fold line.

18. A blank for forming a tray for holding a food product, the blank comprising:

a plurality of panels comprising a bottom panel, a side panel foldably connected to the bottom panel, and an end panel foldably connected to the bottom panel;

a gusset panel foldably connected to the side panel; and rim features for forming a rim structure when the blank is formed into the tray, the rim features comprise a rim panel foldably connected to at least one panel of the plurality of panels at a first lateral fold line, a support panel foldably connected to the rim panel at a second lateral fold line, and an attachment flap foldably connected to the support panel at a third lateral fold line and having a free edge, a first longitudinal distance is defined from the second lateral fold line to the third lateral fold line, and a second longitudinal distance is defined from the third lateral fold line to the free edge of the attachment flap, the first longitudinal distance is approximately equal to the second longitudinal distance.

19. The blank of claim 18, wherein the rim panel is configured to extend generally parallel to the bottom panel, and the support panel is configured to extend obliquely with respect to the rim panel and the side panel when the blank is formed into the tray.

20. The blank of claim 18, wherein the attachment flap is configured to at least partially overlap the side panel when the blank is formed into the tray.

21. The blank of claim 20, wherein the rim panel is configured to extend generally parallel to the bottom panel, and the support panel is configured to extend obliquely from the attachment flap to the rim panel when the blank is formed into the tray.

22. The blank of claim 18, wherein the side panel is a first side panel, the rim features are first rim features and are foldably connected to the first side panel, and the blank further comprises a second side panel foldably connected to the bottom panel and second rim features foldably connected to the second side panel.

23. The blank of claim 22, wherein the rim panel, the support panel, and the attachment flap of the first rim features are a first rim panel, a first support panel, and a first attachment flap, respectively, and the second rim features comprise a second rim panel foldably connected to the second side panel, a second support panel foldably connected to the second rim panel, and a second attachment flap foldably connected to the second support panel.

24. The blank of claim 23, wherein the first rim panel and the second rim panel are configured to extend generally parallel to the bottom panel when the tray is formed from the blank, and the first support panel and the second support panel are configured to extend obliquely from the respective first rim panel and second rim panel toward the respective first side panel and second side panel when the tray is formed from the blank.

25. The blank of claim 23, wherein the first attachment flap is positionable to be at least partially in face-to-face contact with the first side panel when the blank is formed into the tray, and the second attachment flap is positionable to be at least partially in face-to-face contact with the second side panel when the blank is formed into the tray.

26. The blank of claim 23, wherein the end panel comprises a first end panel, the plurality of panels further comprises a second end panel foldably connected to the bottom panel, and the blank further comprises:

a first reinforcement flap foldably connected to the first end panel and configured to at least partially overlap the first end panel when the blank is formed into the tray; and a second reinforcement flap foldably connected to the second end panel and configured to at least partially overlap the second end panel when the blank is formed into the tray.

27. The blank of claim 18, further comprising a reinforcement flap foldably connected to the end panel, the reinforcement flap is configured to at least partially overlap the end panel when the blank is formed into the tray.

28. The blank of claim 27, wherein the reinforcement flap is configured to be at least partially in face-to-face contact with an exterior surface of the end panel when the blank is formed into the tray.

29. The blank of claim 27, wherein the side panel is a first side panel, the gusset panel is a first gusset panel, the plurality of panels further comprises a second side panel foldably connected to the bottom panel, the blank further comprises a second gusset panel foldably connected to the second side panel, the first gusset panel and the second gusset panel are configured to be at least partially in face-to-face contact with the end panel when the tray is formed from the blank, and the reinforcement flap is configured to be at least partially in face-to-face contact with the first gusset panel and the second gusset panel when the tray is formed from the blank.

30. The blank of claim 27, wherein the reinforcement flap is foldably connected to the end panel along a longitudinal fold line, and the end panel comprises an edge extending from an end of the longitudinal fold line away from the reinforcement flap.

31. The blank of claim 30, wherein the edge of the end panel is oblique with respect to the longitudinal fold line.

32. The blank of claim 30, wherein the edge of the end panel is a first edge, the end panel comprises a second edge extending from the first edge to the bottom panel.

33. The tray of claim 18, wherein the rim panel is for extending obliquely upwardly from the first lateral fold line in the tray formed from the blank.

34. A method of forming a tray for holding a food product, the method comprising:

obtaining a blank comprising a plurality of panels comprising a bottom panel, a side panel foldably connected to the bottom panel, and an end panel foldably connected to the bottom panel, a gusset panel foldably connected to the side panel, and rim features comprising a rim panel foldably connected to at least one panel of the plurality of panels at a first lateral fold line, a support panel foldably connected to the rim panel at a second lateral fold line, and an attachment flap foldably connected to the support panel at a third lateral fold line and having a free edge, a first longitudinal distance is defined from the second lateral fold line to the third lateral fold line, and a second longitudinal distance is defined from the third lateral fold line to the free edge of the attachment flap, the first longitudinal distance is approximately equal to the second longitudinal distance;

forming an interior of the tray at least partially defined by the plurality of panels, the forming of the interior of the tray comprising positioning the gusset panel and the end panel to at least partially overlap one another; and forming a rim structure by folding the rim panel and the support panel with respect to the side panel.

35. The method of claim 34, wherein the forming the rim structure further comprises positioning the rim panel to extend generally parallel to the bottom panel and positioning the support panel to extend obliquely with respect to the rim panel and the side panel.

36. The method of claim 34, wherein the forming the rim structure further comprises at least partially overlapping the attachment flap and the side panel.

37. The method of claim 36, wherein the forming the rim structure further comprises positioning the rim panel to extend generally parallel to the bottom panel and positioning the support panel to extend obliquely from the attachment flap to the rim panel.

38. The method of claim 34, wherein the blank further comprises a reinforcement flap foldably connected to the end panel, and the method further comprises at least partially overlapping the reinforcement flap and the end panel.

39. The method of claim 38, wherein the at least partially overlapping the reinforcement flap and the end panel further comprises positioning the reinforcement flap to be at least partially in face-to-face contact with an exterior surface of the end panel.

40. The method of claim 38, wherein the side panel is a first side panel, the gusset panel is a first gusset panel, the plurality of panels further comprises a second side panel foldably connected to the bottom panel, the blank further comprises a second gusset panel foldably connected to the second side panel, the forming the interior of the tray further comprises positioning the first gusset panel and the second gusset panel in face-to-face contact with the end panel, and the at least partially overlapping the reinforcement flap and the end panel further comprises positioning the reinforcement flap to be at least partially in face-to-face contact with the first gusset panel and the second gusset panel.

41. The tray of claim 34, wherein the forming the rim structure comprises positioning the rim panel to extend obliquely upwardly from the first lateral fold line.

* * * * *